United States Patent [19]

Achelpohl

[11] Patent Number: 4,796,499

[45] Date of Patent: Jan. 10, 1989

[54] APPARATUS FOR STACKING AND DELIVERING FLAT ARTICLES, SUCH AS DOUBLE BAGS MADE OF PLASTIC FILM

[75] Inventor: Fritz Achelpohl, Lengerich, Fed. Rep. of Germany

[73] Assignee: Windmöller & Hölscher, Lengerich, Fed. Rep. of Germany

[21] Appl. No.: 33,700

[22] Filed: Apr. 3, 1987

[30] Foreign Application Priority Data

Apr. 4, 1986 [DE] Fed. Rep. of Germany ..... 3611237

[51] Int. Cl.[4] ..... B26D 7/10; B26D 7/02; B26D 5/20; B26F 3/08

[52] U.S. Cl. ..... 83/151; 83/171; 83/277; 83/95; 83/155; 414/27; 414/789.9; 493/204; 493/194; 493/197

[58] Field of Search ..... 83/155, 171, 278, 277, 83/435; 414/27, 43; 493/204, 194, 197; 269/228, 238, 254 CS

[56] References Cited

U.S. PATENT DOCUMENTS 3,480,271 11/1969 Coutilish ..... 269/228
4,285,257 8/1981 Eberle et al. ..... 83/435
4,583,436 4/1986 Asano ..... 83/155
4,699,607 10/1987 Lambrecht ..... 493/204

FOREIGN PATENT DOCUMENTS 2302477 7/1974 Fed. Rep. of Germany .
2819728 11/1979 Fed. Rep. of Germany .
8128146 12/1982 Fed. Rep. of Germany .
3505858 6/1986 Fed. Rep. of Germany .

*Primary Examiner*—Frank T. Yost
*Assistant Examiner*—Scott A. Smith
*Attorney, Agent, or Firm*—Fleit, Jacobson, Cohn & Price

[57] ABSTRACT

An apparatus for stacking and delivering double bags of plastic film receives the bags from a transfer device at a stacking station which includes vertical pins on which the bags are impaled to form a stack. A stack conveyor with built-in grippers moves a completed stack to a severing station where a heated knife separates the double bags lengthwise of their travel while they are still in the grip of the grippers. The severed bags are then transferred to a delivery station where the grippers are released. The conveyor has separate side-by-side runs and separate gripper jaws are carried on each run. The stacking pins and the severing knife are located between the conveyor runs.

9 Claims, 2 Drawing Sheets

APPARATUS FOR STACKING AND DELIVERING FLAT ARTICLES, SUCH AS DOUBLE BAGS MADE OF PLASTIC FILM

FIELD OF THE INVENTION

This invention relates to apparatus for stacking and delivering flat articles, such as double bags, which have been severed by hot wire welding from a tubular or semitubular web of plastic film and which adjacent to their center line have opening-defining edges. The apparatus includes a transfer device preferably consisting of a so-called wicketer, which has pairs of transfer arms arranged in a starlike configuration rotating about a horizontal axis, by which the articles are deposited in a stacking station on an endless stack conveyor. The conveyor comprises tensile means, trained around reversing pulleys, and is intermittently driven. The apparatus includes a retaining plate in the stacking station which carries upstanding stacking pins or stacking needles for impaling the articles received from the transfer device adjacent to their longitudinal center line so as to form stacks, which are subsequently forwarded by the intermittent operation of the tensile conveyor means. The apparatus also comprises a succeeding severing station including a knife, preferably heated, which is movable up and down and severs the stacks along a center line extending in the direction of travel. The apparatus also comprises spring-loaded gripping means for gripping the stacks which have been formed on the stack conveyor by engaging the stacks at their leading edge portion, and actuating means, secured to the frame of the apparatus operable to open and close the gripping means.

BACKGROUND OF THE INVENTION

German Utility Specification No. 81 28 146 discloses an apparatus of a type in which double bags that have been severed from a tubular film along a transverse line, by hot wire welding, are deposited on stacking plates, which are carried by endless chains. The chains are provided on opposite sides of their longitudinal center line with respective rows of stacking pins for receiving the bags and/or with spring-loaded gripping arms by which the stacks which have been formed are clamped on the stack conveyor at the leading edge portions of the stacks. A means for separating the bag stacks comprises a heated knife, which can be moved up and down to sever the stacks in a severing station between the rows of stacking pins in an operation in which the stacking plate constitutes an abutment for the severing knife. Because the stacking plates also constitute the abutments for the heated knives, the plates must be relatively large and heavy in weight. For this reason the known apparatus constitutes a relatively expensive structure because the endless chains must be provided with stacking plates which must be adapted to constitute abutments for the cutting knife and which have the same spacing as the stacks to be transported by the chains.

If the stacks of bags are retained on the stack conveyor by gripping means engaging each stack at its leading edge, it will be necessary to provide for the stacking operation a pair of U-shaped gripping members, which are raised in alternation or simultaneously when each double bag has been deposited and are subsequently lowered in order to retain said double bag on the stack being formed.

But the U-shaped gripping member which centrally engages each stack at its leading edge portion in order to retain the complete stack will prevent a central severing of the stack by the severing knives into two partial stacks. For this reason, stacking pins are suitably provided on opposite sides of the parting line and serve to extend through stacking holes and hold the partial stacks.

SUMMARY OF THE INVENTION

It is an object of the invention to provide an apparatus of the kind initially referred to in which the requirements to be met by the stack conveyor are alleviated so that the apparatus can be built more easily and more economically. Further, the means provided in the apparatus for retaining the complete stacks preferably should comprise gripping means which do not obstruct the central severing cut and which reliably retain the separated partial stacks of the stack conveyor.

In accordance with the invention, the stack conveyor comprises two spaced apart, parallel, revolving belts or chains, and a retaining plate is disposed in the stacking station between the courses of the belts or the like of the stack conveyor and in tracks, which are secured to the frame. The retaining plate is adapted to be raised and lowered in such a manner that stacking pins which may be supported thereby can be lowered below the plane of travel of the conveyor. A severing knife cooperates in a severing station with an abutment which is disposed adjacent to the plane of travel between the courses of the endless conveyor, and the gripping means comprises pairs of grippers secured to respective ones of the conveyor belts or the like.

The stack conveyor may consist of simple pairs of conveyor belts or the like, which may be light in weight because the pairs of conveyor belts or the like serve only to convey and retain the stacks and do not carry backing elements which have the same spacing as the stacks and can take up the cutting pressure in the severing station. A supporting means provided in the stacking station may consist only of the retaining plate, which may carry only two stacking pins or stacking needles. The retaining plate with stacking pins is adapted to be lowered and serves only to assist the formation of each stack in the stacking station. If stacking needles are provided, the articles or double bags to be stacked need not be formed with punched locating holes because the needles can pierce through the articles as they are stacked.

An abutment for the severing knife is provided in the severing station and is fixed to the frame. As a result, the belts or the like of the stack conveyor need not extend between the severing knife and the abutment as the stacks are severed. The gripping means comprising pairs of grippers secured to respective ones of the two conveyor belts or the like enables the space between the grippers to remain free for the passage of the severing knife and there is no need for additional means for retaining the partial stacks which have been separated.

The stacking pins or stacking needles may be suitably heated so that they will join the successively stacked double bags in the stack as it is building up.

The upper jaws of the grippers may be pivoted on transverse horizontal axes to vertical arms or flanges of right-angled plate brackets or of angle sections and the other arms or flanges of said plate brackets or sections may be secured to the conveyor belt or the like to constitute jaws which cooperate with the upper jaws.

In a preferred embodiment of the invention the ends of prestressed tension springs are secured to fixing means respectively provided on the upper jaw and on the vertical arm of the plate brackets, said fixing means consist, for example, of retaining pins or retaining hooks, and said ends of said tension springs are secured to said fixing means in such a manner that during a pivotal movement of the upper jaw from its gripping position to the open position and vice versa the spring is moved through the pivotal axis of said upper jaw so that the tension spring when it is on either side of its neutral position will urge the upper jaw to and will hold it in its gripping position or in its open position. The upper jaw may be provided with an actuating cam, which is engageable by the actuating means for moving the upper jaw from one position to the other. The actuating means may comprise cams, which are fixed to the frame, or shifting plates or the like, which are provided with drive means.

BRIEF DESCRIPTION OF DRAWINGS

An illustrative embodiment of the invention will now be explained more in detail with reference to the drawing, in which.

DESCRIPTION OF PREFERRED EMBODIMENT

Figure 1:
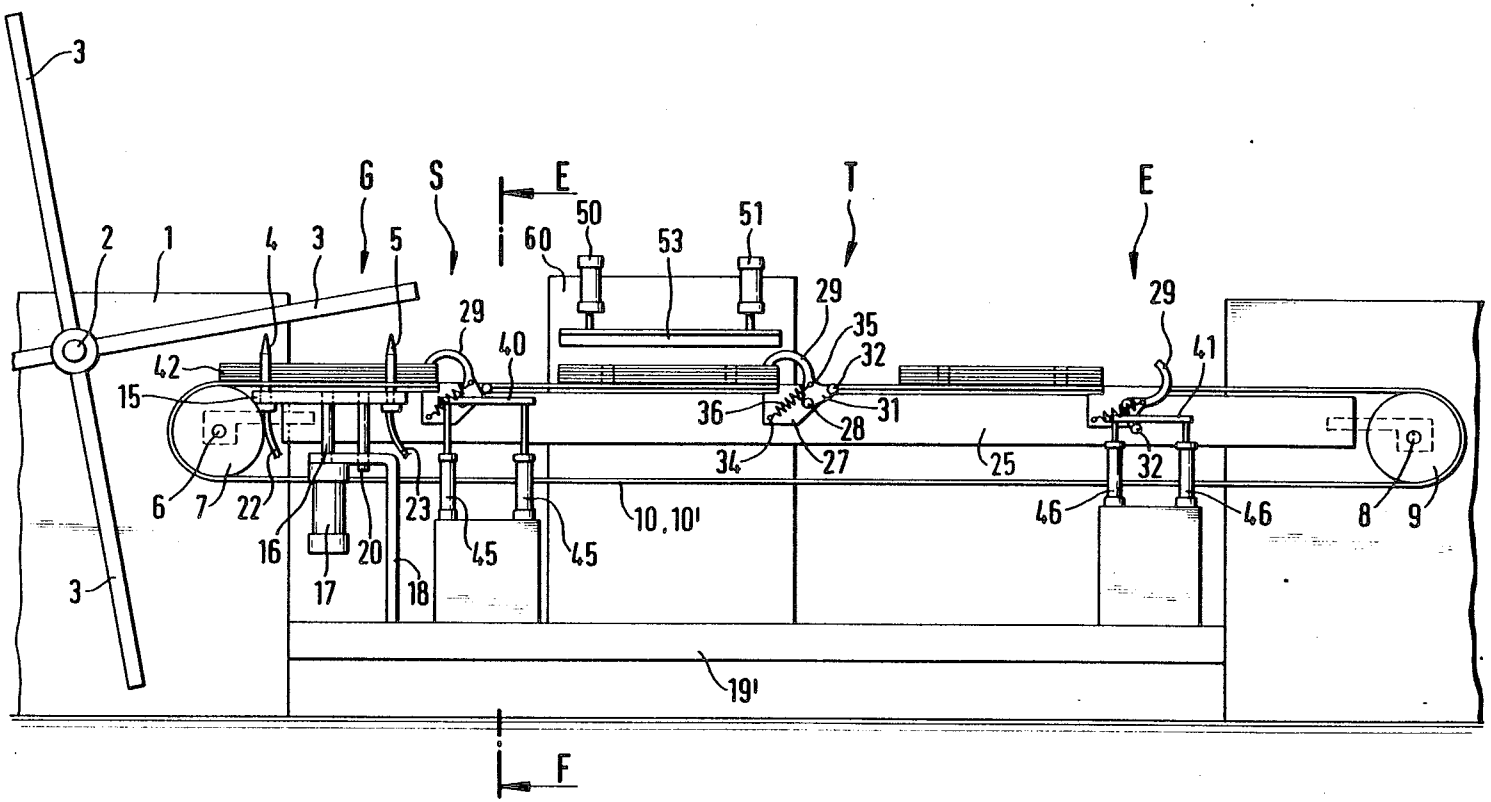
FIG. 1 is a side elevational view of a stacking and delivery apparatus in accordance with the invention.

A shaft 2, which is connected to drive means, not shown, is mounted in side frames 1 of a wicketer frame and carries pairs of transfer arms 3, which are provided with suckers or like gripping means for bags to be stacked. The wicketer frame is preceded by a hot wire welding machine, not shown, for severing the bags along a transverse line from a tubular or semitubular web of plastic film by hot wire welding. From the hot wire welding machine the rotating transfer arms 3 take over the complete double bags, the individual bags of which are joined along a center line, and impale said double bags on stacking pins or needles 4, 5.

A horizontal shaft 6 is mounted in the side frames 1 or in laterally disposed bearing brackets of the wicketer frame. The shaft 6 carries two spaced apart reversing pulleys 7, which are symmetrically disposed with respect to the transverse center plane of the pair of transfer arms 3. Another horizontal shaft 8 is mounted in a frame at the delivery end of the stacking apparatus and carries a pair of reversing pulleys 9 in a corresponding arrangement. Two spaced apart, parallel conveyor belts 10, 10' are trained around the reversing pulleys 7, 9. The pulleys 7, 9 of one pair thereof are connected with an intermittently acting drive, not shown.

A carrying plate 15 is disposed in the stacking station S between the wicketer arms 3, which are arranged in pairs. The plate 15 carries the stacking pins or stacking needles 4, 5, which are secured to the carrying plate and are spaced apart in the transverse center plane between the wicketer arms 3. The carrying plate 15 is secured at its central portion to a piston rod 16 of a fluid-operable piston-cylinder unit 17 for raising and lowering the plate and needles.

The cylinder of the fluid-operable piston-cylinder unit 17 is connected to the horizontal arm of an angle bracket 18, which is welded to the main carrier 19' of the apparatus. To constrain the carrying plate 15 to move parallel to the piston rod 16, the carrying plate 15 is provided with a guide pin 20, which extends through a guiding bore in the horizontal arm of the bracket 18.

The stacking needles 4, 5 may be heated electrically by a heating cartridge, not shown, which is fed with heating current by lines 22, 23.

By operation of the fluid-operable piston-cylinder unit 17, the carrying plate 15 can be lowered to a position in which the points of the stacking needles 4, 5 are below the plane of travel of the conveyor belts 10, 10'.

Figure 2:
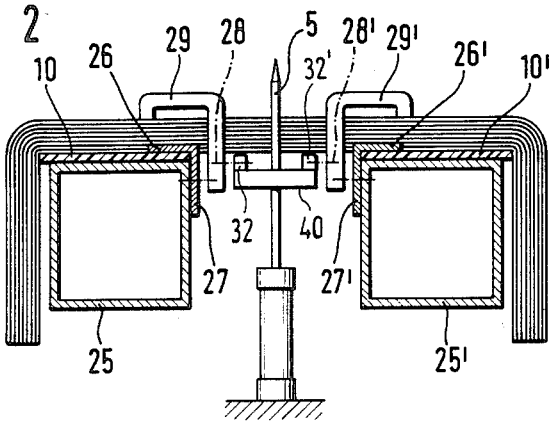
FIG. 2 is a sectional view of line E–F of FIG. 1.
Figure 3:
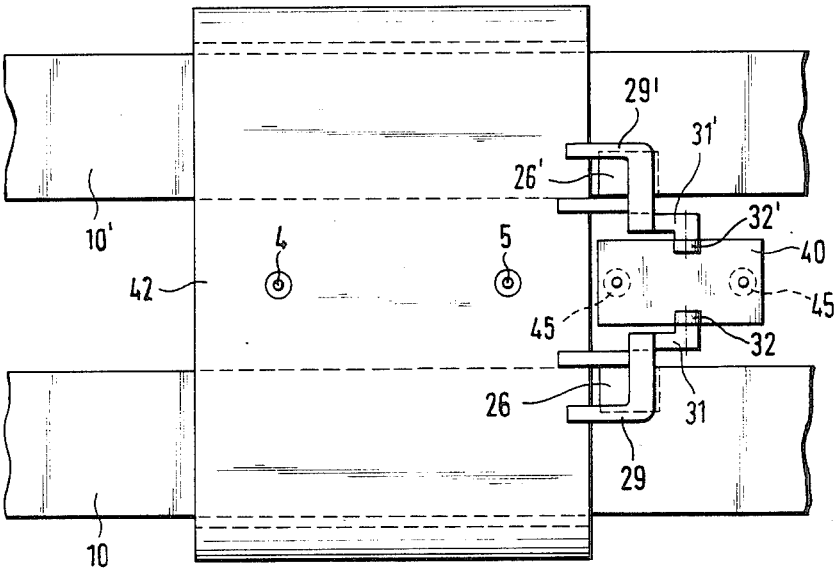
FIG. 3 is a top plan view of a stacking station viewed in the direction of arrow G in FIG. 1.

As is apparent from FIG. 2, the upper courses of the conveyor belts 10, 10' are supported by box-section beams 25, 25' having smooth, polished upper surfaces. At intervals along the respective conveyor belts are attached respective gripper assemblies now described. For each gripper assembly, horizontal arms 26, 26' of plate brackets are joined by rivets or other means (not shown) to the inner edge portions of the respective conveyor belts 10, 10'. Vertical arms 27, 27' of the plate brackets may be backed by engagement with the confronting inner vertical walls of the box-section beams 25, 25' and are provided with horizontal pivot pins 28, 28', on which double-angled gripper arms 29, 29' are pivoted, constituting the upper jaws of the grippers. Arms 29, 29' consist of double-armed bellcrank levers having shorter arms 31, 31', which constitute actuating levers and carry at their free ends cam follower rollers 32, 32'. The horizontal arms 26, 26' of the plate brackets constitute lower jaws of the gripper assemblies.

The gripper arms 29, 29' and the vertical arms 27, 27' of the plate brackets are provided with retaining pins 34, 35 (FIG. 1), to which the ends of prestressed tension springs 36 are secured. The retaining pins 34, 35 are so arranged that the lines of action of the tension springs 36 are moved through the pivotal axis 28 as the gripper arms 29, 29' are pivotally moved from their gripping position to their open position.

FIG. 1 shows the left-hand and central gripper arms in their gripping position whereas the right-hand gripper arm has been pivotally moved to its open position. Because the tension springs 36 move through the pivotal axis 28 as the gripper arm is moved from its gripping position to the open position, a gripper arm which is disposed outside its neutral position will be urged by the tension spring toward its gripping position or toward its open position.

A means for operating the gripper arms 29, 29' of the gripper assemblies comprises shifting plates 40, 41, which are disposed in the stacking station S and adjacent to the delivery end of the stack conveyor 10, 10', respectively. When a stack 42 of double bags has been formed, the shifting plates 40 disposed in the stacking station move the gripper arms from their open position to their gripping position by engagement with rollers 32, 32', so that the stack of bags which has just been formed is held in position on the conveyor belts 10, 10'. The stack can be moved out of the stacking station S when the stacking needles 4, 5 have been lowered and the intermittently operated stack conveyor has subsequently advanced one step. The shifting plate 41 disposed in the delivery station E then depresses the cam follower roller 32 so that the gripper arms 29, 29' are returned to their open position. A means for actuating the shifting plates 40, 41 comprises fluid-operable piston-cylinder units 45, 46, which are secured to the frame.

In the severing station T, two fluid-operable piston-cylinder units 50, 51 are secured to a carrier 60, which is secured to the frame. The piston-cylinder units 50, 51 are disposed above the gap which is defined between the box-section beams 25, 25' and comprise piston rods, which carry a severing knife 53 which may be heated by electric or other known heating means. The knife 53 is adapted to be moved up and down in the longitudinal center plane between the beams 25, 25' by units 50, 51. A knife abutment, not shown, having the same length as each stack 42 is disposed between the beams 25, 25' and secured to the frame. The abutment has a top surface which is aligned with the plane of travel of the conveyors.

During severing of the bags, the gripper arms 29, 29' remain closed, and, after severing the separated bags, still gripped by their respective gripper arms, are moved to the delivery station E where the gripper arms are released.

What is claimed is:

1. In an apparatus for stacking and delivering flat articles, such as double bags, which have been severed by hot wire welding from a tubular or semitubular web of plastic film and which adjacent to their center line having opening-defining edges, the articles being deposited by a transfer device at a stacking station on an endless stack conveyor means supported by a frame, the apparatus including a retaining plate disposed in the stacking station and provided with upstanding stacking pins or stacking needles for impaling the articles adjacent their longitudinal center line so as to form a stack which is to be forwarded by intermittent operation of the conveyor means, the apparatus further including a severing station downstream from the stacking station, the severing station including a knife movable vertically for severing the stack along a center line extending in the direction of travel, spring-loaded gripping means for gripping stacks which have been formed on the stack conveyor by engaging the stacks at their leading edge portion, and actuating means secured to the frame for selectively opening and closing the gripping means; the improvements wherein the stack conveyor comprises two spaced apart parallel, revolving belts, chains or like endless elements, the retaining plate is disposed in the stacking station in tracks between the endless elements and is adapted to be raised and lowered in such a manner that the stacking pins can be lowered below a plane of travel of the endless elements, the knife cooperates in the severing station with an abutment disposed adjacent said plane of travel between the courses of the endless elements, the gripping means comprises pairs of opposed grippers respectively secured to inner edge portions of respective ones of the endless elements, the grippers having opposite actuator elements respectively extending between the endless elements and wherein the actuating means comprises common actuating means located between the endless elements to operate on both of the opposite actuator elements in unison.

2. The improvements as defined in claim 1 wherein the grippers have upper jaws which are pivotally attached about transverse horizontal pivot axes to vertical arms or flanges of angled brackets, the brackets having respective other arms or flanges secured to the respective endless elements to constitute lower gripper jaws which cooperate with the upper jaws.

3. The improvements as defined in claim 2 wherein the grippers include prestressed tension springs secured to fixing means respectively provided on the upper gripper jaw and on the vertical arm of the respective plate bracket, the ends of the tension springs being secured to the fixing means in such a manner that during pivotal movement of said upper jaw from a gripping position to an open position and vice versa, the respective spring is moved through the pivot axis of said upper jaw so that the tension spring when it is on either side of a neutral position will urge the upper jaw to and will hold it in the gripping position or the open position.

4. The improvement as defined in claim 3 wherein the upper jaw of each gripper is provided with an actuating cam constituting the respective actuator element, which is engageable by the actuating means for moving the upper jaw between said positions.

5. The improvement as defined in claim 4 wherein the actuating means comprises cam means secured to the frame.

6. The improvement as defined in claim 3 wherein the actuating means comprises vertically movable shifting plates located at the stacking station and at a delivery station downstream of the severing station and drive means for the shifting plates.

7. The improvement as defined in claim 6 wherein each upper jaw comprises a double-angled lever.

8. The improvement as defined in claim 7 wherein each upper jaw consists of a double-armed lever having one arm which constitutes the gripper jaw and another arm which engages the shifting plate.

9. The improvement as defined in claim 1 including heating means for the stacking needles or pins.

* * * * *